US009797326B2

(12) United States Patent
Wixe et al.

(10) Patent No.: US 9,797,326 B2
(45) Date of Patent: Oct. 24, 2017

(54) METHOD FOR OPTIMIZING A/F RATIO DURING ACCELERATION AND A HAND HELD MACHINE

(71) Applicant: HUSQVARNA AB, Huskvarna (SE)

(72) Inventors: Stefan Wixe, Huskvarna (SE); Martin Axelsson, Hestra (SE); Björn Lundblad, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/124,422

(22) PCT Filed: Mar. 13, 2015

(86) PCT No.: PCT/EP2015/055327
§ 371 (c)(1),
(2) Date: Sep. 8, 2016

(87) PCT Pub. No.: WO2015/136087
PCT Pub. Date: Sep. 17, 2015

(65) Prior Publication Data

US 2017/0016408 A1 Jan. 19, 2017

(30) Foreign Application Priority Data

Mar. 13, 2014 (SE) ..... 1450284

(51) Int. Cl.
*F02D 41/10* (2006.01)
*F02D 41/14* (2006.01)
*F02B 63/02* (2006.01)

(52) U.S. Cl.
CPC ..... *F02D 41/10* (2013.01); *F02B 63/02* (2013.01); *F02D 41/1475* (2013.01);
(Continued)

(58) Field of Classification Search
CPC .. F02D 41/10; F02D 41/1475; F02D 41/1497; F02D 2400/06; F02D 41/045;
(Continued)

(56) References Cited

U.S. PATENT DOCUMENTS 5,709,193 A * 1/1998 Svensson ..... F02D 31/007 123/333
9,255,535 B2 * 2/2016 Larsson ..... F02D 31/007

FOREIGN PATENT DOCUMENTS

EP 272814 A2 6/1988
EP 715686 B1 2/1999
(Continued)

OTHER PUBLICATIONS

International Search Report and Written Opinion for International Application No. PCT/EP2015/055327 dated Jun. 22, 2015, all enclosed pages cited.
(Continued)

*Primary Examiner* — Erick Solis
*Assistant Examiner* — Robert Werner
(74) *Attorney, Agent, or Firm* — McNair Law Firm, P.A.

(57) ABSTRACT

Method for optimizing the current A/F settings when accelerating the engine over at least one defined speed interval, the method comprising comparing at least two acceleration times of different A/F ratio that each encompasses at least one defined speed interval. Adjusting the A/F ratio based on the comparison.

15 Claims, 3 Drawing Sheets

(52) U.S. Cl.
CPC .. *F02D 41/1497* (2013.01); *F02D 2200/1012* (2013.01); *F02D 2400/06* (2013.01)

(58) Field of Classification Search
CPC ..... F02D 2200/101; F02D 2200/1012; F02D 27/00; F02D 27/02; F02B 63/02
USPC ..... 701/103, 104, 110; 73/114.13, 114.24, 73/114.25; 123/370, 399, 436, 492
See application file for complete search history.

(56) References Cited

FOREIGN PATENT DOCUMENTS

| | | | |
|---|---|---|---|
| EP | 2284378 | A2 | 2/2011 |
| EP | 2357344 | A1 | 8/2011 |
| WO | 2009011690 | A2 | 1/2009 |
| WO | 2012115548 | A1 | 8/2012 |

OTHER PUBLICATIONS

Chapter I International Preliminary Report on Patentability for International Application No. PCT/EP2015/055327 dated Sep. 13, 2016, all enclosed pages cited.

* cited by examiner

METHOD FOR OPTIMIZING A/F RATIO DURING ACCELERATION AND A HAND HELD MACHINE

TECHNICAL FIELD

The invention relates to a method for optimizing the A/F settings of an internal combustion engine.

BACKGROUND

In all internal combustion engines, IC engines, the air/fuel ratio is of utmost importance for the engine function. Usually the air/fuel ratio is referred to as the A/F-ratio, A and F signifying respectively air and fuel. In order to achieve a satisfactory combination of low fuel consumption, low exhaust emissions, good runability and high efficiency the A/F-ratio must be maintained within comparatively narrow limits. The requirements that exhaust emissions from the IC engine to be kept low are becoming increasingly stricter. In the case of car engines these requirements have led to the use of exhaust catalyzers and to the use of sensors and probes positioned in the car exhaust system in order to control the A/F-ratio.

However, for consumer products, such as power saws, lawn mowers, and similar products, this technology is difficult to use for mounting reasons and also for cost-efficiency and operational-safety reasons. For instance, in a power saw, a system with sensors and probes would result in increased size and weight as well as a drastic rise in costs and possibly also cause operational safety problems. Further the sensor or the probe often requires a reference having completely pure oxygen, which is a situation that it is practically impossible to achieve in some engines, for instance the motors of power saws.

Expected future legislation with respect to CO-emissions from small IC engines may make it difficult to use manually adjusted carburetors. Given the manufacturing tolerances that could be achieved in the case of carburetors it is impossible, with the use of fixed nozzles in the carburetor, to meet these legal requirements and at the same time guarantee the user good runability in all combinations of air-pressures and temperatures, different fuel qualities and so on.

EP 0 715 686 B1 describes a method of controlling the engine A/F-ratio without the use of an oxygen sensor (lambda probe). Initially, the A/F-ratio is changed briefly. This could be effected for instance by briefly throttling or stopping the fuel supply. In connection with the change, a number of engine revolution times are measured. The revolution times relate to engine rotational speeds chosen in such a manner that at least one revolution of the engine is unaffected by the change, preferably an engine rotational speed that is sufficiently early for the A/F-ratio change not having had time to affect the engine rotational speed. Further at least one forthcoming revolution of the engine is chosen in such a manner that it is affected by the brief A/F-ratio change. In this manner it becomes possible to compute a revolution-time difference caused by an A/F-ratio change. On the basis of this revolution-time difference a change, if needed, of the mixture ratio in the desired direction towards a leaner or richer mixture is made. Thus using this method an optimal mixture can be achieved by testing how the engine reacts to a leaner or richer mixture. However, the engine control method of EP 0 715 686 B1 is somewhat slow and also requires the product to be run under a load when fine-tuning the A/F ratio. However, machines such as clearing saws and trimmers are usually not operated under constant load.

Another example of A/F control is disclosed in WO 2012/115548. The A/F-ratio is adjusted to a desired level based on measurements at speeds close to a cut-out speed threshold where the engine speed will fluctuate around the threshold. The A/F-ratio is briefly changed during a test period, typically lasting 4-20 revolutions, which will affect engine speed data. The affected engine speed data are compared with the un-affected speed data. If the comparison indicates an increase in acceleration after combustion/s the A/F-ratio is adjusted in the same direction as during the brief change, and in the opposite direction in case of an indication of a decrease. The indicating parameter may e.g. be the period length, the amplitude of the engine speed around the cut out speed threshold or the rate of acceleration after combustion.

The control method of WO 2012/115548 functions satisfactory but is limited to be applied at certain running conditions requiring that testing is performed at cut-out, i.e. the engine is at wide open throttle and no load. Furthermore, determination of the A/F-ratio adjustment is not directly depending on a measured parameter but indirectly on a measured parameter which then is indicative of the determining criterion. This might entail uncertainty in respect of the adjustment relevance.

Object of the Invention

It is an object of the invention to provide a method for optimizing the A/F ratio of combustion engines of hand held machines such as clearing saws, trimmers, chainsaws, and power cutters. In particular it is an object to overcome the limitations and/or drawbacks related to prior art.

SUMMARY OF THE INVENTION

At least one of the problems or objects mentioned above is at least to some degree addressed by providing a method for optimizing the current A/F setting, the method comprising the steps of:

a) Defining at least one speed interval, b) Based on a reference acceleration employing the current A/F setting, providing at least one reference acceleration time corresponding to the time passing the defined at least one speed interval, c) Providing a first test A/F setting by increasing or decreasing the current A/F setting, d) Based on a first test acceleration employing the first test A/F setting, providing at least one first test acceleration time corresponding to the time passing the defined at least one speed interval, e) Comparing the first test acceleration time/s with the reference acceleration time/s to determine if the first test acceleration was faster than the reference acceleration, f) If the first test acceleration was determined to be faster, adjusting the current A/F setting in the direction of the first test A/F setting relative to the A/F setting employed during the reference acceleration, and optionally restarting at step b.

It is supposed to be evident that the expression "time passing . . . " means "the time required to traverse . . . ".

By analyzing how the acceleration times of defined speed intervals are affected by different A/F settings, the A/F ratio can be optimized. By defining one or more speed intervals that are not limited to a certain operation condition such as running at cut-out speed, the invented control method becomes more generally applicable for different kind of users and/or machines. A speed interval may be ranging from idle speed to the maximum speed or may be any fraction thereof. Applying the test to one or more speed intervals that can be freely chosen and where one and the same speed interval is run at reference condition and test condition, respectively, provides that the measuring is representative and provides reliable adjustment criteria. According to the invention the parameter determining the adjustment is the acceleration time for passing a speed interval. This is directly decisive for the adjustment resulting in a high accuracy. Since the acceleration time has a substantial duration in comparison with parameters that are almost momentary, the relevance becomes particular high.

The invented control method thus provides high flexibility with regards to its application and is more secure, precise and relevant than can be achieved with known methods. Preferably the method further comprises the steps of:

g) If the first test acceleration was not determined to be faster, providing a second test A/F setting by adjusting the current A/F setting in the opposite direction compared to the first test A/F setting, h) Based on a second test acceleration employing the second test A/F setting, providing at least one second test acceleration time corresponding to the time passing the defined at least one speed interval, i) Comparing the second test acceleration time/s with the reference acceleration time/s to determine if the second test acceleration was faster than the reference acceleration, j) If the second test acceleration was determined to be faster, adjusting the current A/F setting in the direction of the second A/F setting, k) Optionally restarting at step b.

According to this embodiment thus a second test is performed in case the first test indicates that the acceleration is negatively affected. By applying a second test a more reliable adjustment is achieved than if adjustment is based solely on the first, negative test.

Preferably, the defined speed intervals are at least two, preferably at least three and at most 20, preferably at most 10, more preferably at most 5.

The idea of using more than one speed interval is important for attaining a control that is as relevant as possible since broad running conditions are covered by the plurality of tests. For avoiding a too circumstantial control process it is however practical to keep the number of speed intervals limited. In most cases a number of speed intervals from three to five represent an adequate balance between the desire to have an accurate control and the desire not to make the control too complicated.

The defined speed intervals are preferably distributed over an acceleration range between an engine idle speed and an engine maximum speed. For instance, it may be within the range of 50-250 rps or within the range of 100-220 rps.

By such a distribution the test results will be optimized regarding the need to have them representative and accurate. The preferred ranges explicitly defined are in most cases particularly relevant for the kind of machines to which the invention primarily is intended.

The defined speed intervals are preferably evenly distributed over the acceleration range.

The even distribution further increases the optimization mentioned above.

Preferably, two adjacent speed intervals partially overlap each other, such that an upper endpoint of a lower interval is above the lower endpoint of a higher interval, preferably each overlap is within the range of 5-40 rps, more preferably 10-30 rps.

Overlapping the intervals to a certain degree is a measure that still further contributes to make the control reliable.

Preferably, each speed interval has a length within the range of 10-200 rps, preferably 20-60 rps.

Preferably, each defined speed interval encompasses the same amount of rps.

In one embodiment, the defined speed intervals encompass increasing amounts of rps with increasing speeds.

In at least one of step b), d) or h), acceleration time/s for speed intervals that was not passed during the engine accelerations may be estimated.

When comparing acceleration time/s; comparing acceleration time/s with respect to the same speed interval/s.

Preferably, when comparing acceleration time/s; assigning higher weight to acceleration times corresponding to certain speed interval/s, to give those more influence when determining which of the accelerations was fastest or slowest. For instance by assigning larger the weight for acceleration time/s at higher engine speeds and/or by assigning lower weight for speed interval/s where the acceleration time/s is estimated.

Preferably, acceleration times for a certain speed interval are compared only provided that the throttle position was constant throughout the whole interval, i.e. provided that the throttle valve was maintained at the same degree of opening throughout the whole interval. The throttle position may be determined by means of a throttle position sensor of the type disclosed in WO200911690. The output of the throttle position sensor may be used to determine whether the throttle position was constant throughout the whole interval, i.e. based on the output of the throttle position sensor it can be determined whether the comparison should be performed or not.

Preferably, the acceleration times are measured at wide open throttle.

The method is particularly suitable for two stroke crank case scavenged engines.

The last mentioned embodiments are also such that the accuracy and reliability of the control is increased.

According to a second aspect, the invention relates to a hand held machine such as a clearing saw, trimmer, chainsaw or power cutter driven by an internal combustion engine, in particular a two-stroke engine, whereby the machine is provided with means arranged for performing the method according to the present invention, in particular according to any of the preferred embodiments thereof.

The invented machine has advantages corresponding to those of the invented method and to the preferred embodiments thereof, respectively, which advantages are described above

DESCRIPTION OF THE INVENTION

Figure 1:
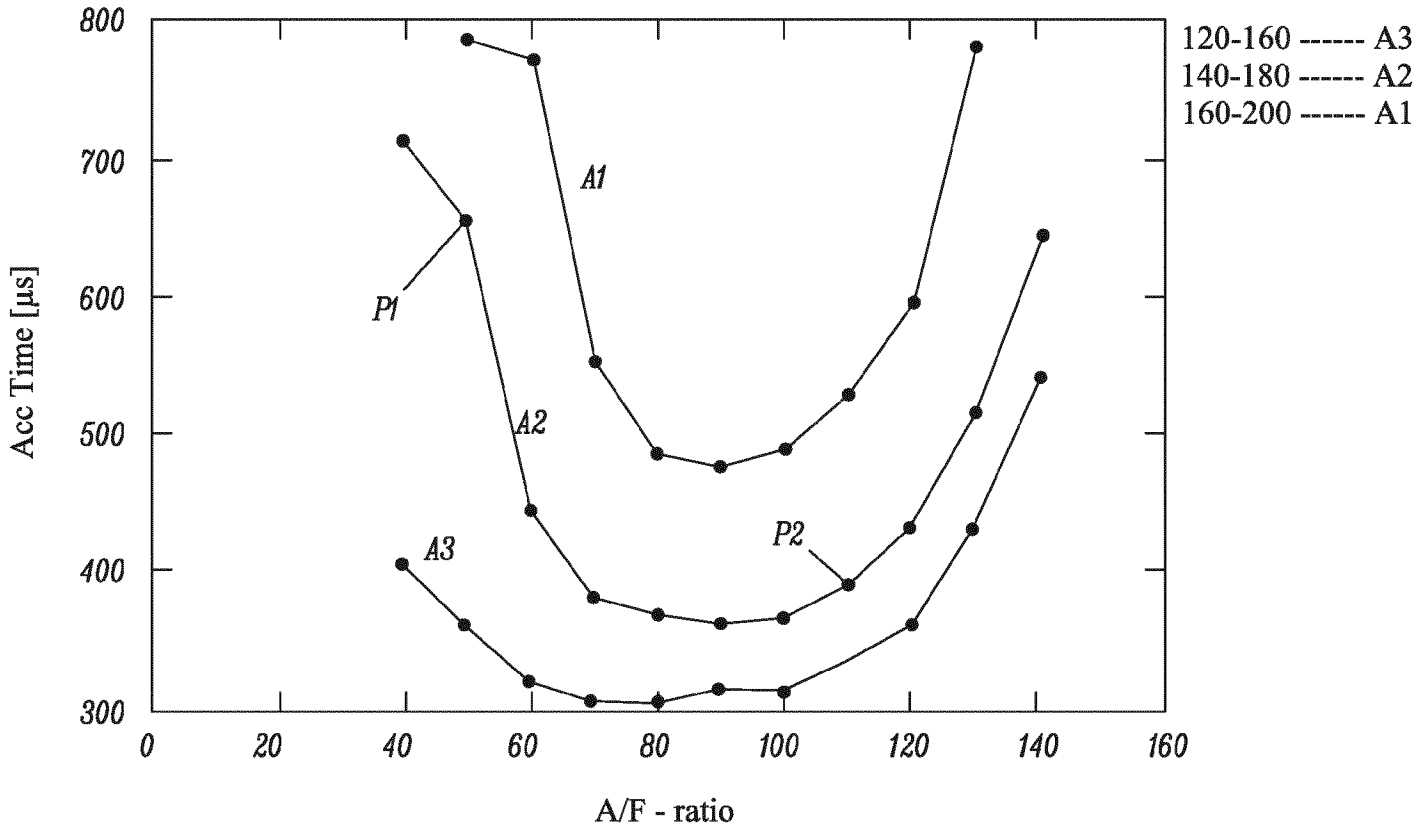
FIG. 1 is diagram showing accelerations times for different speed intervals and A/F-ratios.

FIG. 1 shows an example of how the acceleration times for three speed intervals A1, A2, and A3 can vary with different A/F ratios. The A/F-ratio is in the diagram represented by the number of closings of the fuel valve during a period cycle of 256. The cycle may last for more than one revolution, e.g. four revolutions of the engine. The x-axis thus shows decreasing A/F-ratio towards the left, where 0 means maximum fuel supply and 256 means no fuel supply. Each curve show the times passing a speed interval, A1, A2, and A3 as functions of the A/F-rates. The speed interval A1 is 160-200 rps, interval A2 is 140-180 rps and interval A3 is 120-160 rps. For each speed interval a number of measuring points are indicated.

From the diagram can be seen that the acceleration time has a minimum at a certain A/F-ratio. Looking for example to the graph representing A2 and assuming that P1 represents the reference A/F setting being 50, it can be seen that for this point the acceleration time from 140 to 180 rps is 0.65 ms. Then the A/F setting is changed to e.g. 110, represented by measuring point P2. It can be seen that the acceleration time for A2 at this A/F-rate is 0.40 ms, i.e. lower than the reference acceleration time. This indicates that the A/F setting is to be adjusted from the A/F-ratio in P1 towards the A/F-ratio in P2, such that a shorter acceleration time will be obtained. The adjusting may be performed iteratively, whereby the adjusted A/F-ratio is used as the reference.

By measuring the change of acceleration time also for A1 and A3 a more reliable optimization of the A/F-ratio can be achieved. In that case the results of the measurements on each speed interval A1, A2 and A3 are added together for the adjustment. This may include that the different speed intervals are giving different weights depending on their relevance.

Figure 2:
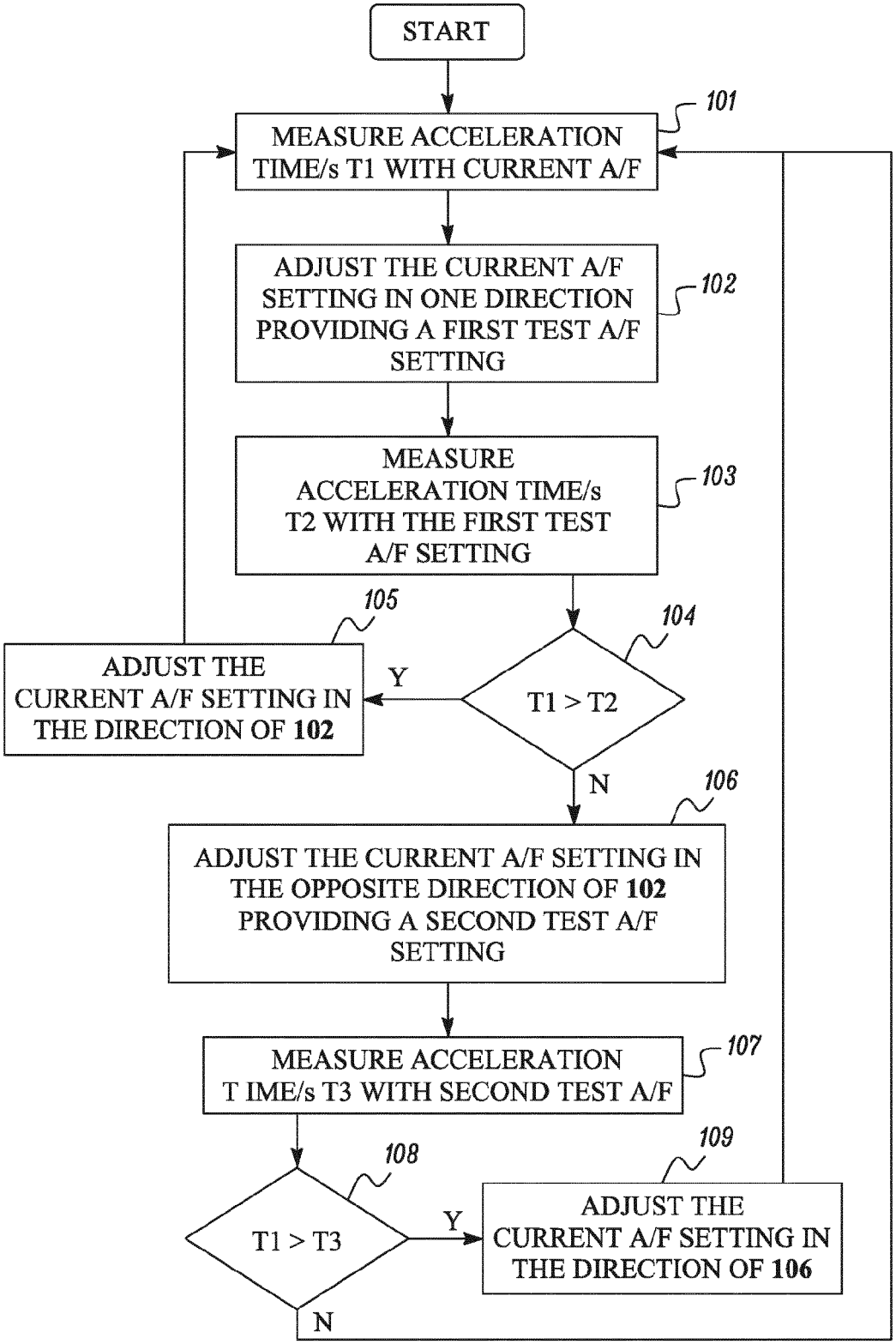
FIG. 2 shows schematically a control method to find an optimized A/F ratio.

The control method which will be described in more detail in relation to FIG. 2 is using the fact that acceleration is dependent of A/F-ratio and that the best (shortest) acceleration time is obtained at optimal A/F ratio. Hence the basic idea is to find the shortest acceleration time for each speed interval by testing different A/F ratios.

Of course neither the length nor the number of speed intervals are limited to the shown example.

The speed intervals are defined to be within an acceleration area ranging from idle speed to a maximum speed of the engine. E.g. within the range of 50-250 rps, suitably within 80-220 rps. Suitably the lowest speed interval starts from an engine speed that is well above idle speed, preferably 20-60 rps above an average idle speed. For instance if idle speed is around 50-60 rps, the lowest interval may e.g. start from 80, 90, or 100 rps. The highest speed interval may be up to a maximum engine speed. It may also be up to a predetermined speed below a maximum engine speed, for instance 10-50 rps below a maximum engine speed.

FIG. 2 shows a flow chart of a control algorithm for finding an optimal A/F ratio. In a first step 101 at least one reference accelerations time T1 for the current A/F setting, the reference A/F setting, is measured. The reference accelerations time/s T1 corresponds to the time/s passing at least one of the defined speed interval/s A1, A2, A3. Ideally at least one reference acceleration time for each speed interval A1, A2, and A3 is gathered. Possibly several reference acceleration times T1 for each speed intervals A1, A2, A3 to minimize variations. If a speed interval is not encompassed during acceleration, the corresponding acceleration time may be estimated.

Thereafter, in a step 102, a test A/F setting is employed by adjusting the current A/F setting, i.e. increasing or decreasing the A/F ratio. The A/F setting can e.g. be adjusted by controlling the air supply or the fuel supply.

In a step 103 at least one first test acceleration time T2 is measured. The first accelerations time/s T2 corresponds to the time/s passing at least one of the defined speed interval/s A1, A2, A3. Ideally at least one first test acceleration time for each speed interval A1, A2, and A3 is gathered. Possibly several first test acceleration times T2 for each speed intervals A1, A2, A3 to minimize variations. If a speed interval A1, A2, A3 is not encompassed during acceleration, the corresponding acceleration time may be estimated.

In a step 104, the reference acceleration time/s is compared to the first test accelerations time/s to determine if the first test acceleration/s was faster than that of the reference A/F setting.

Acceleration time/s corresponding to the same speed interval/s are compared to each other. The comparison could give extra weight to certain speed intervals. For instance some speed intervals may from e.g. statistical analysis have been found to be more reliable and such intervals could thus be given more weight. For instance, the weight may be increased for acceleration time/s at higher engine speeds. A speed interval/s where the test and/or reference acceleration times T1, T2 is estimated could be given lower weight.

If the first test acceleration was determined to be faster a step 105 follows. In step 105 the current A/F setting is adjusted in the direction of the first A/F setting. The current A/F setting is preferably adjusted by a smaller step than that of the first test A/F setting. Thereafter the control method is restarted from step 101.

If the first test acceleration was not determined to be faster a step 106 follows. In step 106, a second test A/F setting is provided by adjusting the current A/F setting in the opposite direction compared to the direction of the adjustment of the first test A/F setting. The second test A/F setting in step 106 is preferably adjusted relative to the reference A/F setting in step 101, i.e. if the first test A/F setting in step 102 was leaner than the reference A/F setting in step 101, the second test A/F setting in step 106 is chosen so as to be richer than the reference A/F setting in step 101 and vice versa. Alternatively, the second test A/F setting in step 106 is adjusted relative to the first test A/F setting in step 102.

In a step 107 at least one second test acceleration time T3 is measured. The second acceleration time/s T3 corresponds to the time/s passing at least one of the defined speed interval/s A1, A2, A3. Ideally at least one second test acceleration time for each speed interval A1, A2, and A3 is gathered, possibly, several second test acceleration times T3 for each speed intervals A1, A2, A3 to minimize variations. If a speed interval A1, A2, A3 is not encompassed during acceleration, the corresponding acceleration time may be estimated.

In a step 108, the reference acceleration time/s is compared to the second test accelerations time/s to determine if the second test acceleration/s was faster than that of the current A/F setting.

Acceleration time/s corresponding to the same speed interval/s are compared to each other. The comparison could give extra weight to certain speed intervals. For instance some speed intervals may from e.g. statistical analysis have been found to be more reliable and such intervals could thus be given more weight. For instance increasing the weight for acceleration time/s at higher engine speeds. A speed interval/s where the test and/or reference acceleration times T1, T3 is estimated could be given lower weight.

If the second test acceleration was determined to be faster a step 109 follows. In step 109 the current A/F setting is adjusted in the direction of the second A/F setting. The current A/F setting is preferably adjusted by a smaller step than that of the second test A/F setting. Thereafter the control method is restarted from step 101.

If the second test acceleration was not determined to be faster, the control method is restarted from step 101.

Preferably, in the step 102, following step 101, the current A/F setting is adjusted in the same direction as in step 105 if step 101 was followed by step 105 and in the direction of step 109 if step 101 was followed by step 109. Preferably, in the step 102, following step 101, the current A/F setting is adjusted in the same direction as last time in step 102 if step 101 was followed by step 108. Alternatively, if step 101 is followed by step 108, the current A/F setting is adjusted in the direction of the earlier step 106.

Preferably, in the step 102, the current A/F setting is adjusted in the opposite direction relative to the direction of the last adjustment if the last adjustment was unsuccessful, i.e. the last adjustment caused the acceleration time to be longer than the reference acceleration time T1, otherwise the current A/F setting is adjusted in the same direction as the direction of the last adjustment.

Figure 3:
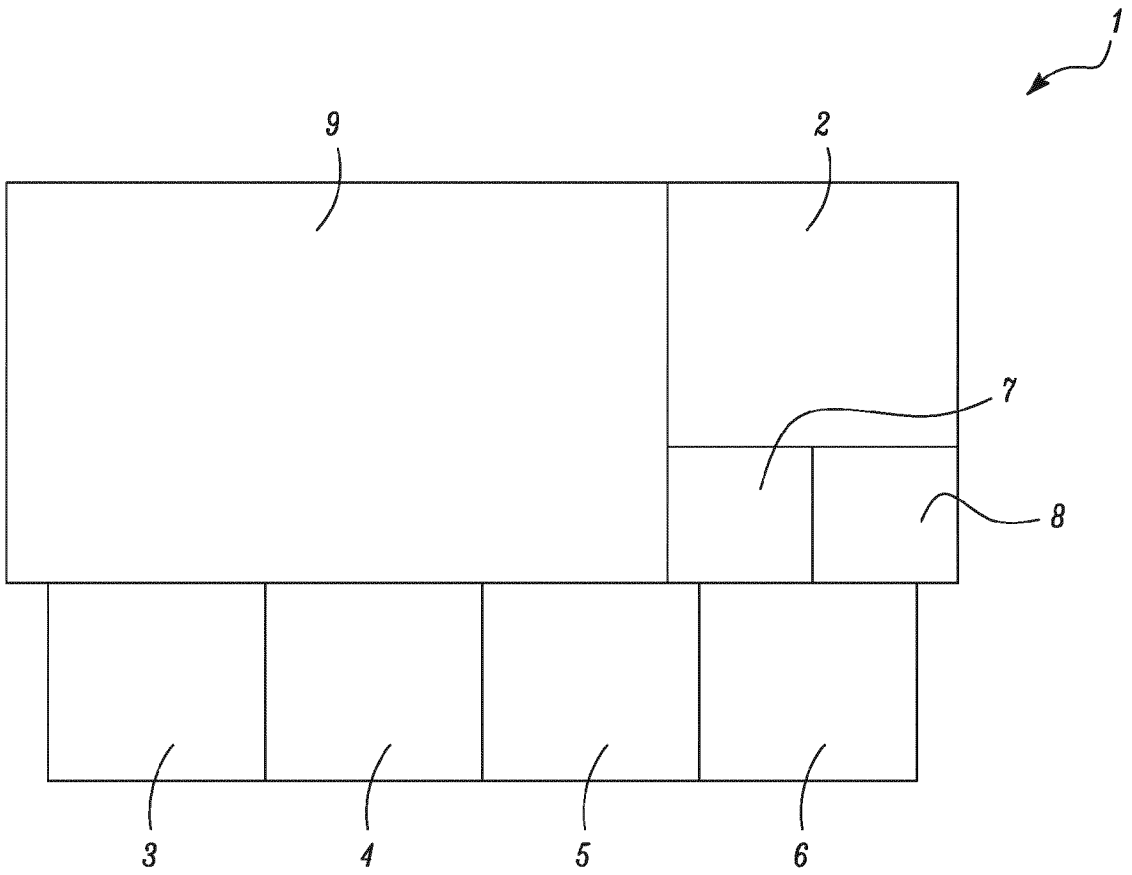
FIG. 3 in a diagram illustrates a machine according to the invention

FIG. 3 in a block diagram illustrates a machine according to the invention, for example a chain saw. The machine has a tool part 9 driven by a two-stroke IC engine 2. The machine is provided with a control device 1 arranged such that the above described method for optimizing the A/F setting can be performed.

Through an A/F-control unit 3 the A/F-setting is recorded and the unit has means for adjusting the A/F setting.

A speed measuring unit 4 has speed measuring means measuring the rps of the engine. The speed measuring unit 4 also has means indicating one or more speed interval by defining the speeds at the lower and upper ends of the speed interval in question. The ranges and number of the speed intervals are in correspondence with what is said above about the method. The ranges and/or the number are preset and fixed. Alternatively the speed control unit may be provided with calibrating means for selecting appropriate ranges for the speed intervals and/or appropriate number of speed intervals.

The time measuring unit 5 is connected to the speed control unit 4 and is trigged to start time measurement at the lower end of the speed interval and to stop measurement at its upper end such that the time for the acceleration between the ends of the interval is obtained.

A processor unit 6 collects coordinated data from the other units such that a measured time is coupled to a certain A/F-setting and a certain speed interval. The measured time for a certain speed interval is compared with the measured time for the same speed interval but at a different A/F-setting. The processor unit provides an output for adjusting the A/F-setting according to the invented method described above. Providing the output may include algorithms for treating the measured values, in particular when a plurality of speed intervals are measured, when the method is repeatedly performed and when different measurements are given different weight.

The output is arranged to automatically adjust the A/F-setting according to the invented method.

Alternatively the output may only provide information to the operator for a manual adjustment.

The software of the control device 3,4,5,6 is for illustrative purpose described as being functionally related to separate units. It is however to be understood that the units in practice preferably are more or less integrated. The main interfaces with the hardware of the machine are an rps-sensor 7 and an A/F setting device 8. The rps-sensor is related to the ignition system emitting pulses that counts the number of revolutions per second. The A/F setting device may be of the type adjusting the number of closings of the fuel valve during a defined a cycle period, e.g. a 256-period system.

The skilled person will understand that the control device 1 may include further control functions than those described above and may be more sophisticated in adaption to the various preferred embodiments of the invented method. The means required for that are inherently deductive from the descriptions of these embodiments of the method.

The invention claimed is:

1. A method for optimizing a current A/F setting for an engine comprising:

a) defining at least one speed interval having a range of speeds, b) based on a reference acceleration employing the current A/F setting, providing at least one reference acceleration time corresponding to time passing the defined at least one speed interval, c) providing a first test A/F setting by increasing or decreasing the current A/F setting, d) based on a first test acceleration employing the first test A/F setting, providing at least one first test acceleration time corresponding to the time passing the defined at least one speed interval, e) comparing the at least one first test acceleration time with the at least one reference acceleration time to determine if the first test acceleration was faster than the reference acceleration, and f) if the first test acceleration was determined to be faster, adjusting the current A/F setting by adjusting an air or fuel supply to the engine in a direction of the first test A/F setting relative to the current A/F setting employed during the reference acceleration, and optionally restarting at step b.

2. The method according to claim 1 further comprising the steps of:

g) if the first test acceleration was not determined to be faster, providing a second test A/F setting by adjusting the current A/F setting in an opposite direction compared to the first test A/F setting, h) based on a second test acceleration employing the second test A/F setting, providing at least one second test acceleration time corresponding to the time passing the defined at least one speed interval, i) comparing the at least one second test acceleration time with the reference acceleration time to determine if the at least one second test acceleration was faster than the reference acceleration, j) if the second test acceleration was determined to be faster, adjusting the current A/F setting by adjusting the air or fuel supply to the engine in a direction of the second A/F setting, and k) optionally restarting at step b.

3. The method according to claim 1 wherein the defined at least one speed interval includes at least two speed intervals, and at most 5 speed intervals.

4. The method according to claim 1, wherein the defined at least one speed interval is distributed over an acceleration range between an engine idle speed and an engine maximum speed, such that the defined at least one speed interval is within the range of 100-220 revolutions per second (rps).

5. The method according to claim 4, wherein the defined at least one speed interval is evenly distributed over the acceleration range.

6. The method according to claim 1, wherein two adjacent speed intervals partially overlap each other, such that an upper endpoint of a lower interval is above a lower endpoint of a higher interval within a range of 10-30 revolutions per second (rps).

7. The method according to claim 6, wherein the higher interval and the lower interval each have a length within a range of 20-60 rps.

8. The method according to claim 6, wherein the higher interval and the lower interval each encompass a same amount of rps.

9. The method according to claim 6, wherein the higher interval and the lower interval each encompass increasing amounts of rps with increasing speeds.

10. The method according to claim 1, wherein at least one of step b), d) or h) comprises estimating acceleration time/s for at least one defined speed interval that was not passed during the engine acceleration.

11. The method according to claim 1, wherein comparing acceleration time/s comprises comparing acceleration time/s with respect to a same speed interval/s.

12. The method according to claim 1, wherein comparing acceleration time/s comprises assigning higher weight to acceleration times corresponding to certain speed interval/s, to give the acceleration times corresponding to the certain speed interval/s more influence when determining which accelerations are fastest or slowest.

13. The method according to claim 12, further comprising assigning larger weight for acceleration time/s at higher engine speeds.

14. The method according to claim 12, further comprising assigning lower weight for speed interval/s where acceleration time/s is estimated.

15. The method according to claim 1, wherein acceleration times are measured at wide open throttle.

* * * * *